United States Patent [19]

Sanko

[11] 4,199,088

[45] Apr. 22, 1980

[54] SWEATER MACHINE

[75] Inventor: John R. Sanko, Altoona, Pa.

[73] Assignee: Paris Manufacturing Company, Inc., Brockway, Pa.

[21] Appl. No.: 940,499

[22] Filed: Sep. 8, 1978

[51] Int. Cl.[2] ..... D06F 71/18; D06F 71/40

[52] U.S. Cl. ..... 223/67; 223/70

[58] Field of Search ..... 223/51, 67, 69, 70, 223/73, 76; 34/103, 239

[56] References Cited

U.S. PATENT DOCUMENTS

| | | | |
|---|---|---|---|
| 2,338,776 | 1/1944 | Miller | 223/67 |
| 2,487,657 | 11/1949 | Larson et al. | 223/73 |
| 2,554,307 | 5/1951 | McCloskey | 223/73 |
| 2,841,315 | 7/1958 | Paris | 223/70 |
| 3,165,244 | 1/1965 | Dosal | 223/67 |
| 3,216,633 | 11/1965 | Paris | 223/70 |
| 3,737,080 | 6/1973 | Paris | 223/70 |
| 3,883,051 | 5/1975 | Bailey | 223/73 X |

*Primary Examiner*—Louis Rimrodt

*Attorney, Agent, or Firm*—Parmelee, Miller, Welsh & Kratz

[57] ABSTRACT

An upright machine for finishing a sweater-like garment has a non-permeable bag that defines a lower hot air and steam-receiving and mixing chamber. A cross-extending, vertically adjustable stretch carriage is provided and has means for gripping the lower edge of the body of a garment being processed; it cooperates with an upper pair of horizontally outwardly extending sleeve and shoulder receiving and stretching, supporting arm frames. A vertically extending perforated plate assembly supplies steam bursts directly within the body of the garment, and means is also provided for directly supplying steam within shoulder and sleeve portions of the garment along the arm frames. A pair of oppositely positioned vertical side arms are adjustably suspended from inner end portions of the arm frames for inside engagement with the body of the garment for stretching it horizontally outwardly; and the carriage is employed to stretch the body longitudinally downwardly. Mixed hot air and steam from the lower chamber pass through the carriage to enter the body of the garment.

4 Claims, 15 Drawing Figures

30
20
20a
21
G
49
60
62
50b
70
64a
50
48
46
45
47
b
10a
12
43
9
A
10
23
22
50a

GARMENT (Sweater)
Steam
VIII
D
C
B
A
F
H
30
31
32
33
34
34a
35
36
40
40a
25
25a
25b
20
20b
21
21a
26
d
e
55
49
50
51
54
54a
48
45
46
46a
44
43
42
41
17
17a
16
22
14
10
10a
9

FIG. 7.
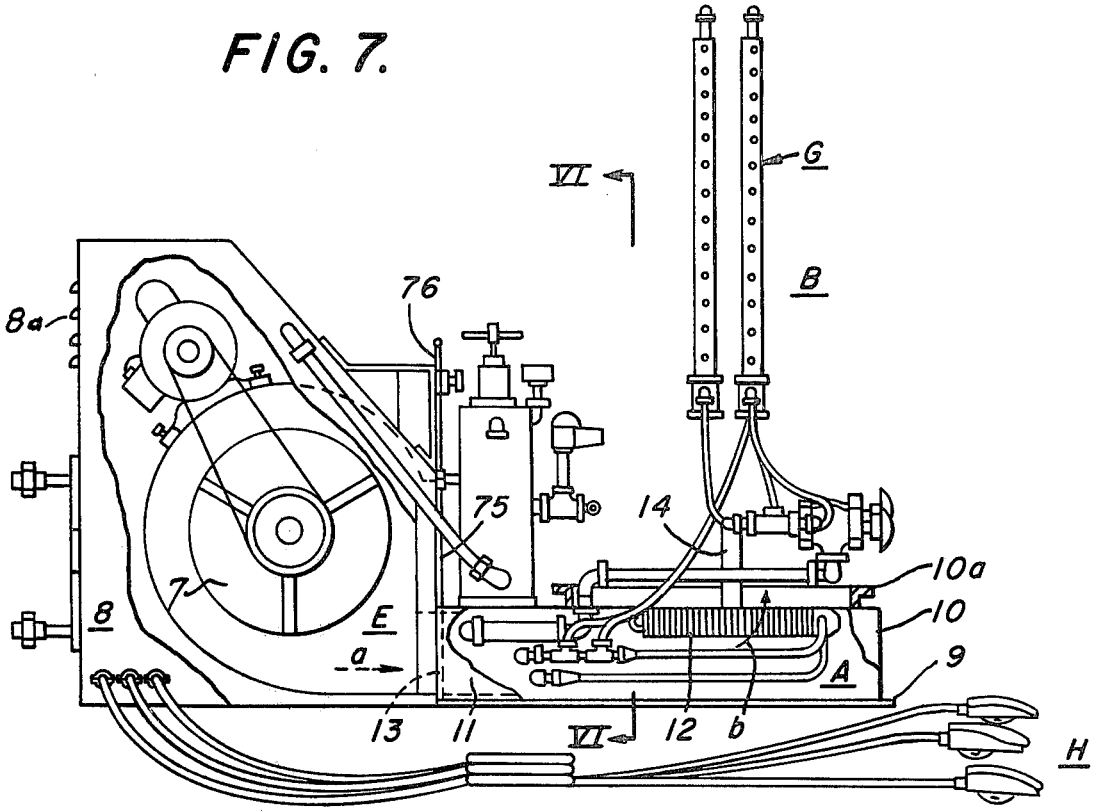
FIG. 8.
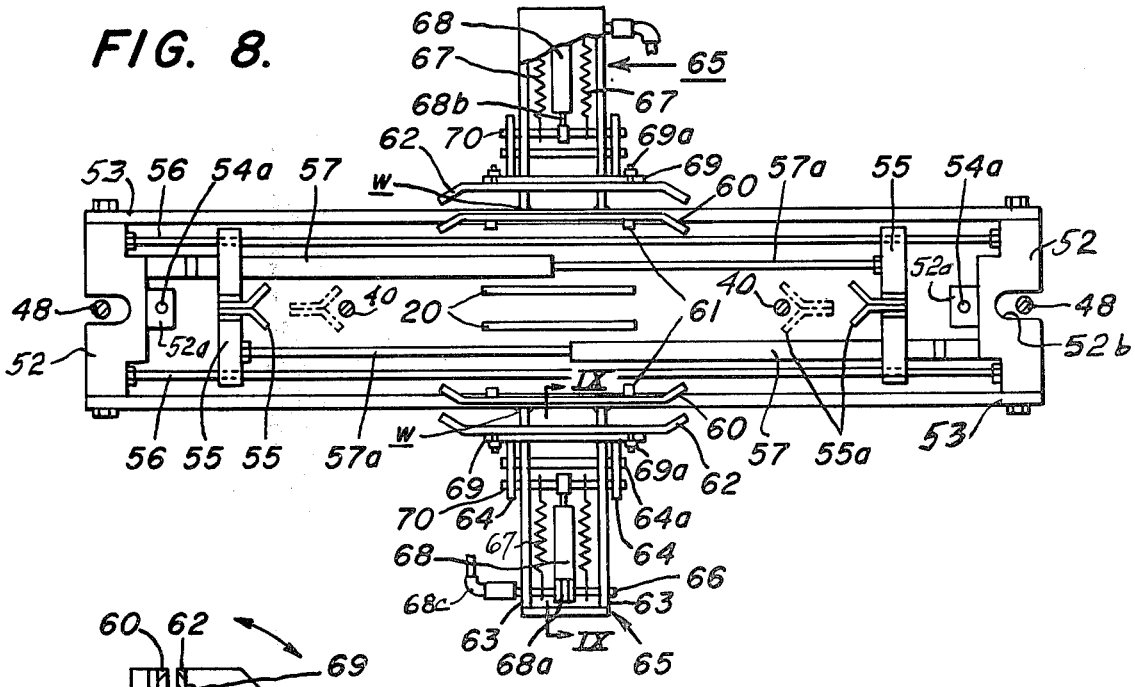
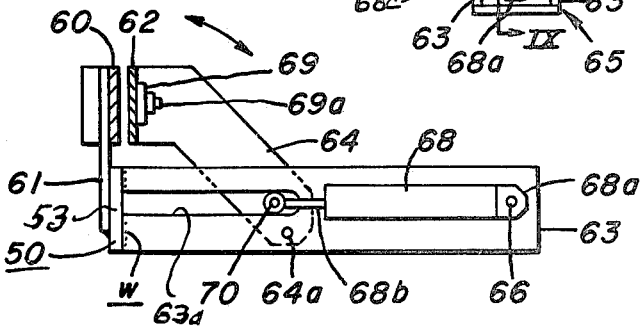
FIG. 9.

24
24a
24b 24
24a
24b
22b
23
22a
22

Steam
25
36
35
25
36
Control Valve for Steam Tubes
Control Valve for Sleeve Tubes
Steam Gauge
Syphon
Steam In
Strainer
Steam Separator
Steam Solenoid
Adapter
Check Valve
Condensate Line
12
Heat Exchanger
Steam Return to Boiler
Check Valve
Steam Trap

SWEATER MACHINE

BRIEF SUMMARY OF THE INVENTION

This invention pertains to a machine which will effectively shape and finish a sweater-like garment throughout and particularly, to a processing apparatus which has means for stretching and maintaining the garment in a suitable desired shaped relation while supplying air and dry steam internally thereof for finishing it.

BRIEF DESCRIPTION OF THE DRAWINGS

FIG. 7 is a reduced side view in elevation particularly illustrating air supplying and heating means, as well as a steam-burst supplying upright tube assembly of the apparatus of FIGS. 1 and 2.

FIG. 8 is an enlarged horizontal section taken along the line VIII—VIII of FIG. 1.

FIG. 9 is a further enlarged vertical sectional detail taken along the line IX—IX of FIG. 8.

DETAILED DESCRIPTION

Figure 2:
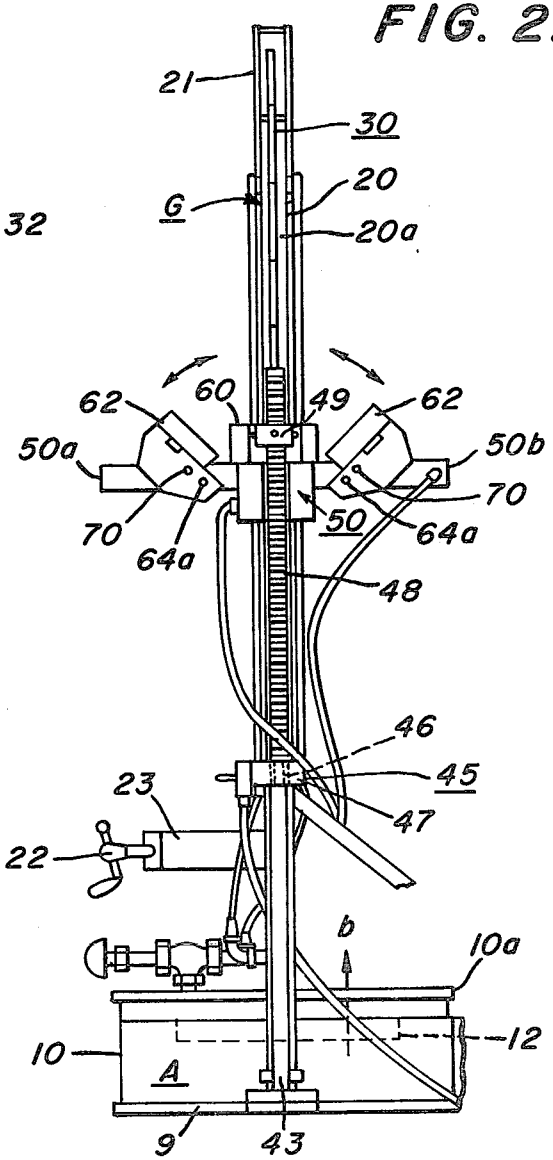
FIG. 2 is an end view in elevation on the scale and of the apparatus of FIG. 1, but with the chamber-defining bag removed.

The apparatus or machine of the present invention has been devised to meet a need in the garment finishing art wherein a sweater-like garment is to be preshaped and finished for sale or, after usage, is to be cleaned and then reshaped and finished for the owner. Heretofore, the emphasis has been placed upon the shaping or forming of the body of the garment from the standpoint of its outward radius and without particular regard to the need for accurately stretching and shaping arm and shoulder portions thereof and for stretch-conforming the body in an elongated relation. The present apparatus has been devised to meet this need and particularly, to provide means in combination for not only positioning and retaining arm and shoulder portions of a garment in a desired shaped relation, but also for providing the body thereof with an improved radial shaping and a desired lengthwise stretch-shaping. The apparatus is provided with means for supplying dry steam, as well as heated air, not only within and along the body of the garment, but also within and along arm-shoulder and collar portions thereof.

FIG. 7 is representative of an apparatus construction to which the invention may be applied. The apparatus or machine is shown provided with an air heating chamber A which is defined by a support wall or base 9 and by a circular housing 10 which is integral with the base. Ambient air may be supplied to the base heating chamber A through a connecting-passageway-defining open-end duct portion 11 from an ambient air pick-up and blower chamber E. As shown, the chamber E is provided with a conventional electric motor-driven ambient-air-receiving and pressurizing blower unit 7 to draw-in ambient air through louvers **8*a* in a blower housing 8. As indicated by the arrow a, the air is moved along an open passageway in the connecting duct 11** into an end opening in the chamber A.

Figure 6:
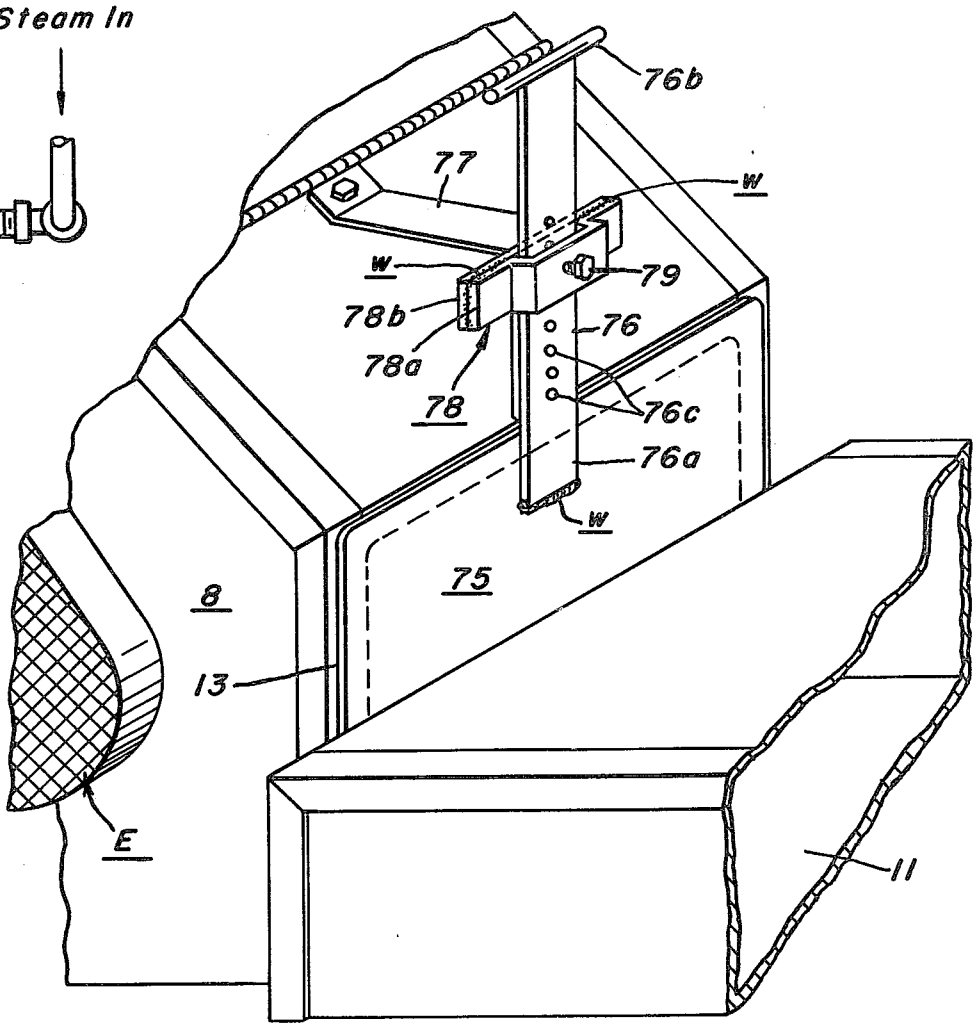
FIG. 6 is an enlarged fragmental isometric section taken along the line VI—VI of FIG. 7, particularly illustrating a side-positioned air supply portion of the apparatus with a slidably adjustable air-flow control door.

A valve seat 13 about the opening into the duct 11 cooperates with a plate-like, vertically adjustable, flow-control door 75. As shown particularly in FIG. 6, an upwardly extending, strap-like adjustment leg 76 is secured, as by weld metal w, to the door 75 by a tab end portion **76*a*. The upper end of the vertical adjustment leg 76 has a cross-extending rod 76*b* which serves as a hand grip or handle for slidably moving it up and down within a slide bracket assembly 78. The bracket assembly 78 has a backwardly extending mounting arm 77 that is shown bolted to the top of the housing 8. The bracket assembly 78 has a front, cross-extending, centrally outwardly offset strap portion 78*a* which is secured, as by weld metal w, to a planar, cross-extending back portion 78*b* to define an open slot for bypassing the adjustment leg 76 therethrough. A set screw or bolt 79 is threadably adjustably mounted centrally within the offset portion 78*a* of the bracket 78 to engage within one of a series of spaced-apart adjustment holes 76*c* along the adjustment leg 76. This construction enables the door 75 to be adjusted to provide any desired size of flow opening to the duct 11** and, if desired, to completely close-off the flow.

Room temperature air, as shown in FIG. 7, flows under forward pressure, as indicated by the arrow a, into the heating chamber A and upwardly through the interstices of a heat exchanger 12. As indicated by the arrow b, it thereafter flows as a hot fluid into a mixing chamber B (see also FIG. 1) which is located immediately above and is, at its bottom end, open to the chamber A. The chamber B is defined by a flexible, non-permeable enclosing means, such as a bag F, that is carried between the housing 10 and a cross-extending, vertically adjustable carriage frame 50. The bag F has flexible folds which enable it to be carried between a circular flange 10*a* about the upper end of the housing 10 and a circular flange 51 about the under side of the vertically adjustable carriage 50. Opposite open ends of the bag F may be provided with drawstrings or other suitable mounting means to assure a substantially fully enclosed chamber B.

The need for a flexible, non-permeable enclosing means F is due to the fact that the carriage frame 50 is adapted to be adjusted, as will be hereinafter particularly pointed out, to stretch or elongate the body of a garment that is to be finished on the machine. It will be noted that the chamber B is not only supplied with dry, hot air from the air heating chamber A, but as somewhat diagrammatically shown in FIG. 7, may be supplied with dry steam from an upright tubular steam assembly G that, as shown in FIGS. 3 and 7, extends vertically, centrally, upwardly within the machine.

Figure 1:
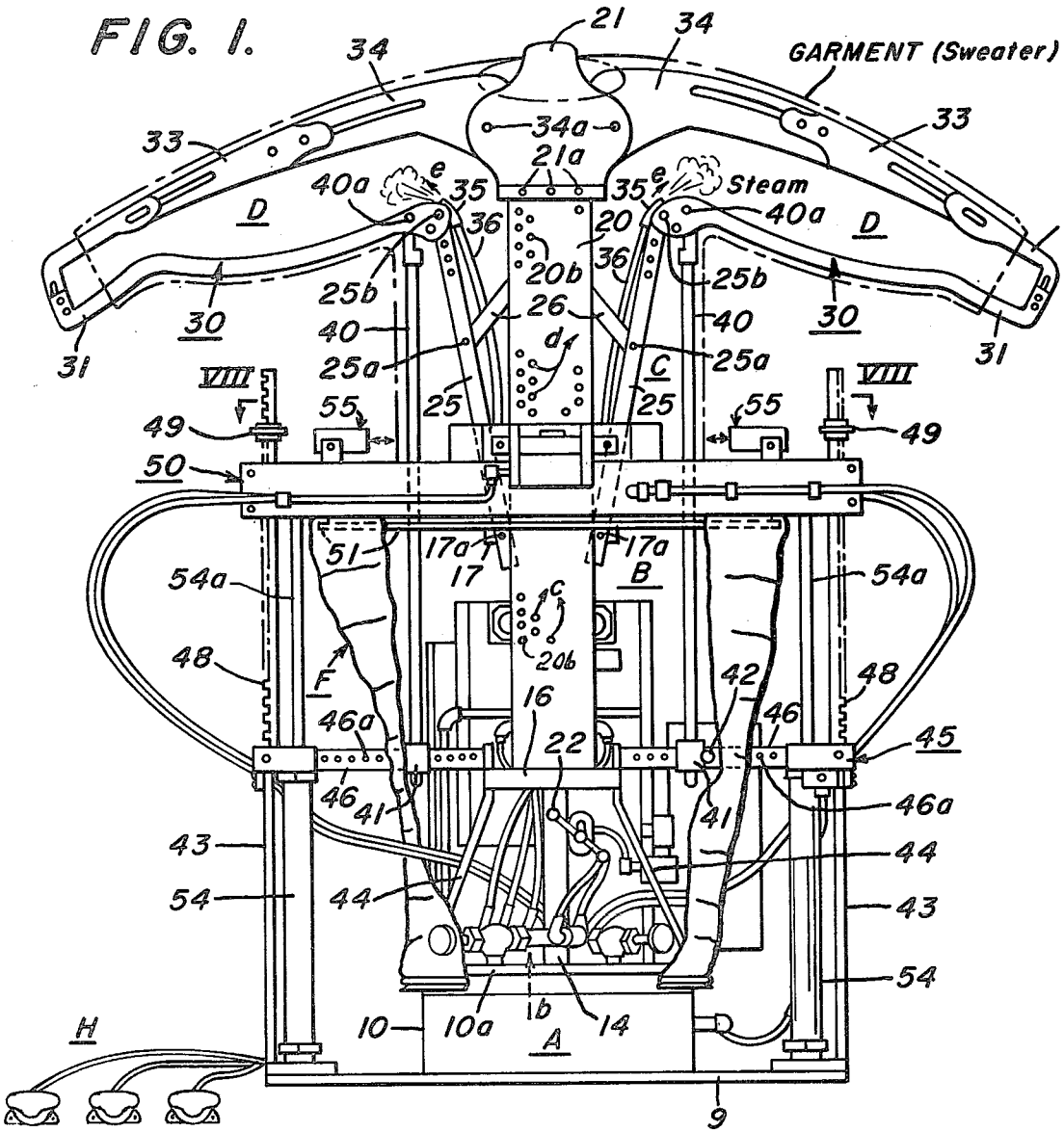
FIG. 1 is a front view in elevation of a machine constructed in accordance with the invention, with a non-permeable, lower, chamber-defining bag broken-away to better illustrate working parts.
Figure 3:
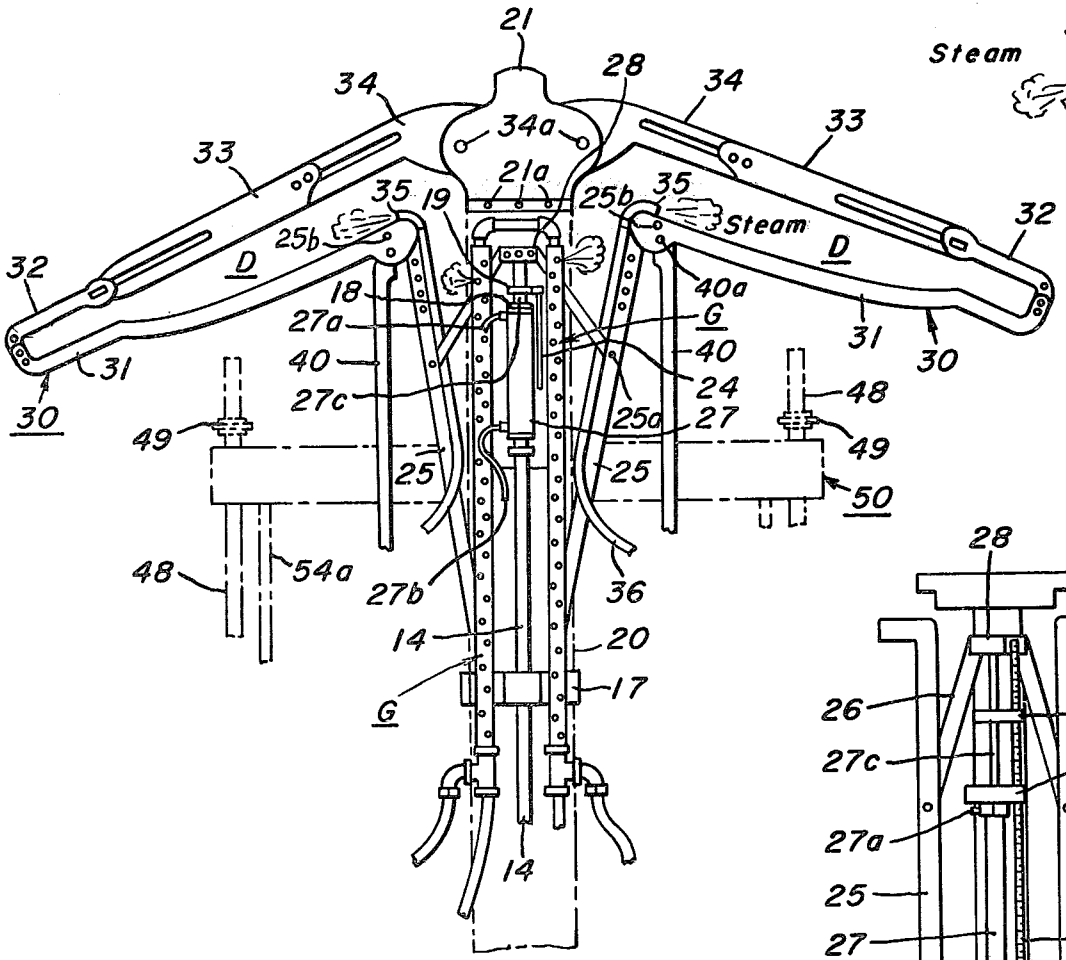
FIG. 3 is a front view in elevation and partial section of an upper portion of the apparatus of FIG. 1, showing details of inner parts thereof that are employed in expanding and contracting arm-shoulder frames of the apparatus.
Figures 10, 10A, 11:
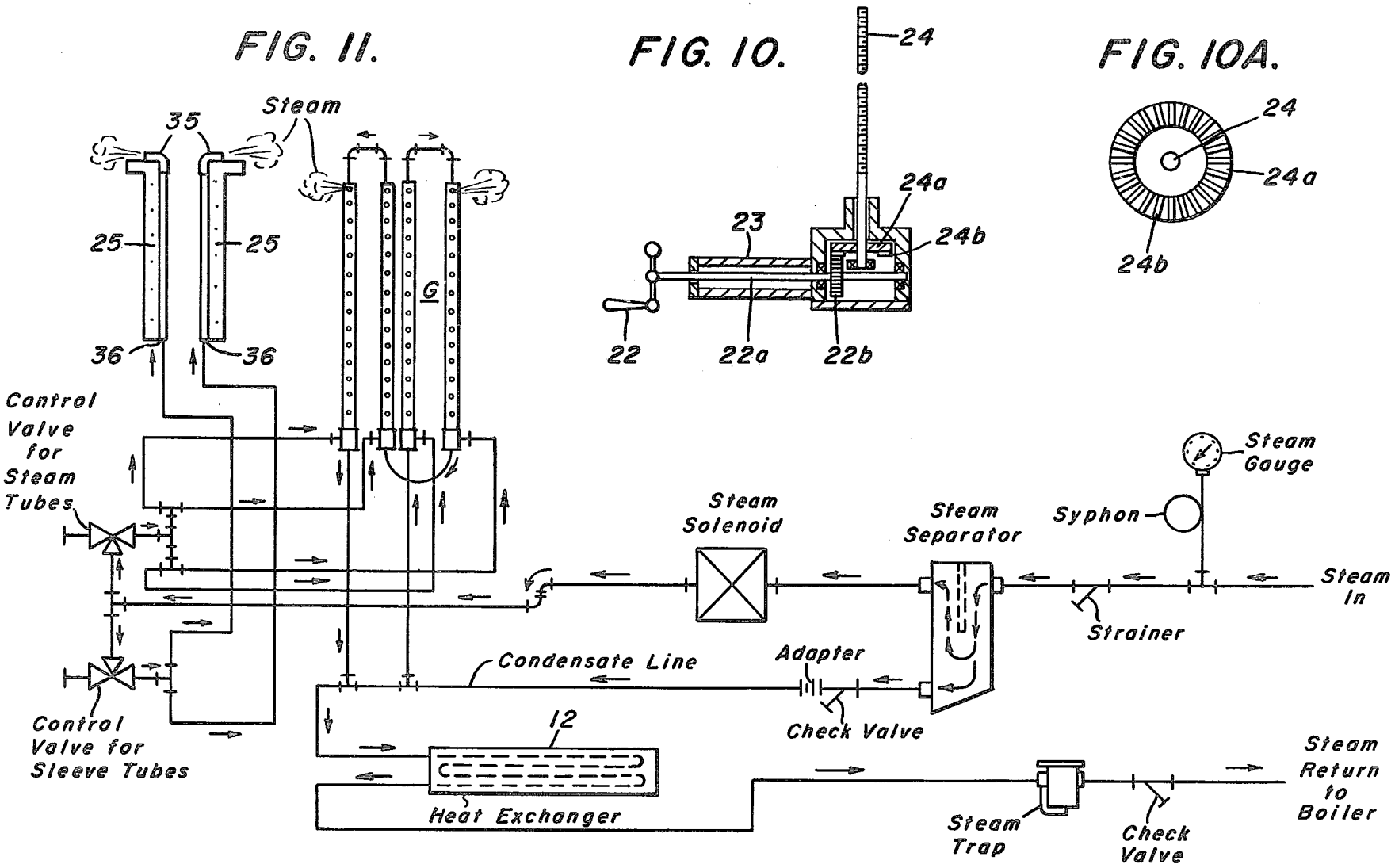
FIG. 10 is an enlarged front section in elevation showing details of the construction of representative means for adjusting the position of a stop block (see FIGS. 3, 4A and 4B) for limiting the outward spread or expansion of frame members which are used for spreading and introducing steam into shoulder assemblies of FIG. 3.
FIG. 10A is an enlarged horizontal fragmental view looking upwardly internally of the housing of the adjusting means of FIG. 10.
FIG. 11 is a steam supply schematic with appropriate descriptive indicators showing a representative steam supply and circulating system for the apparatus of FIG. 1; and, FIG. 12 is a schematic showing an air or fluid system for various operations of the apparatus of FIGS. 1 and 2 and particularly, for controlling the operation of pneumatic or fluid motors or cylinders.
Figure 12:
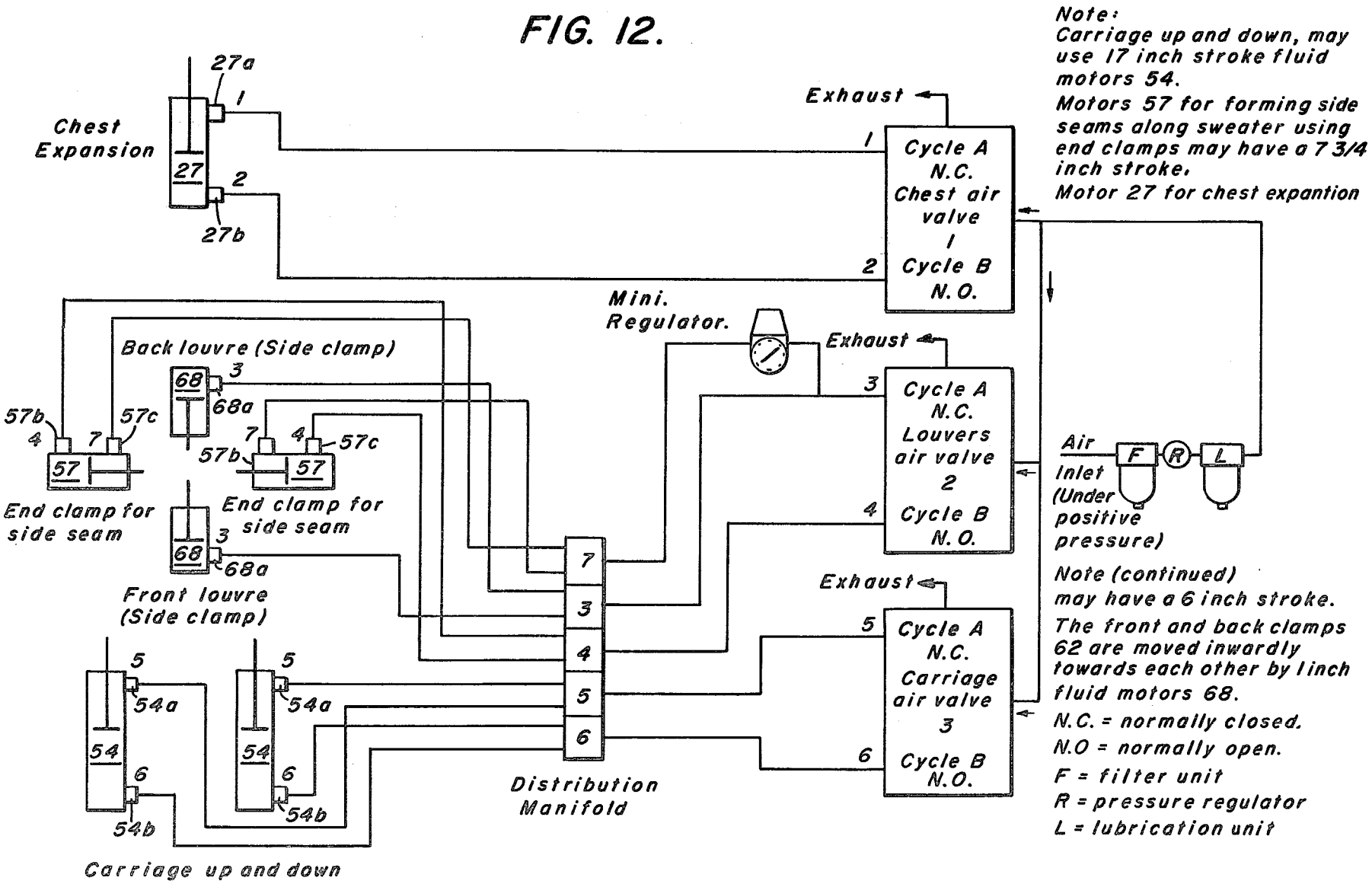

As shown in FIGS. 1, 3 and 11, the assembly G may be used to supply dry steam bursts into the mixing chamber B through spaced-apart, encompassing orifices or interstices 20*b*, as indicated by the arrows c, along the lower end portions of a perforated counter or breast plate assembly 20. It also supplies dry steam in an outflow manner through upper perforations or openings 20*b*, as indicated by the arrows d, into an upper, garment-body-defined and finishing chamber C. The outflow through the upper portion of the assembly 20 is thus directly within the inner confines of a garment such as a sweater that is positioned on the machine for finishing. In this connection, see the dot and dash lines of FIG. 1. If a permeable bag (not shown) is interposed between the inside of the garment and the chamber C, or also along the arm-shoulder or sleeve finishing chamber D, the outflow indicated by the arrows d will be within the inside of the bag.

In FIG. 1, an assembly of foot switches H is shown and may be utilized in any conventional manner for electrical energization of the machine. As shown particularly in FIGS. 1, 3 and 4, a centrally positioned, upright post or support column 14 that is secured at its lower end within a collar or hub portion 15*a* (see FIG. 5) of a supporting, wheel-like frame 15, becomes a stationary part of the structure. The frame 15 is secured within the inside of the housing 10 in alignment with its bag-receiving rim 10*a*. Perforated counter or breast plate assembly 20 has a pair of perforated, vertically extending, plate members (see also FIGS. 1 and 2) which are mounted in an opposed spaced-apart relation along and upward beyond the post 14 to define a fluid-dispersing chamber therealong. The lower end of the assembly 20 is secured to and carried by a strap-like banding assembly 16 which forms a central connection and support for a horizontally extending pair of cross members 46 and to therewith, define an intermediate, stationary frame 45 with a pair of vertical legs 43. The legs 43 are secured at their lower ends, see particularly FIG. 2, on end extensions of the support base 9.

A cross piece 17 (see FIGS. 4, 4A and 4B) is secured at an intermediate position on the post 14 for at 17*a* pivotally receiving lower end portions of a pair of upwardly extending, operating arms 25 for a pair of side-projecting, oppositely positioned pair of shoulder and sleeve forming arm assemblies 30.

Figure 4:
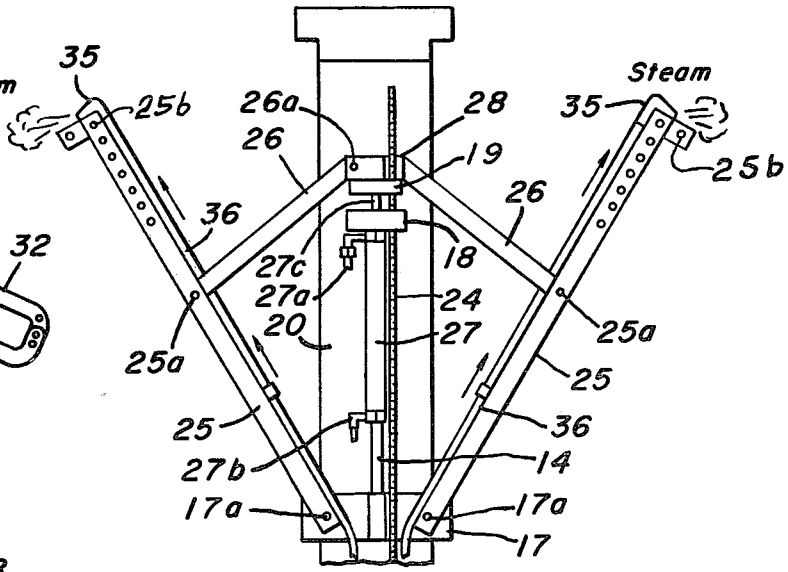
FIG. 4 is a slightly enlarged fragmental front view in elevation showing shoulder frame operating and steam supplying member assemblies illustrated in FIG. 3 in an upwardly-outwardly expanded relation.
Figure 4B:
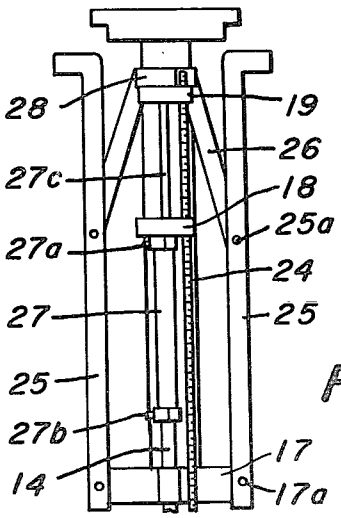
FIGS. 4A and 4B are fragmental front views on the scale of FIG. 4 showing the members in an inward contracted relation, but with different adjusted positions of a limit or stop block for controlling the maximum downward movement of the piston rod of a fluid motor employed in expanding and contracting the member assemblies.
Figure 4A:
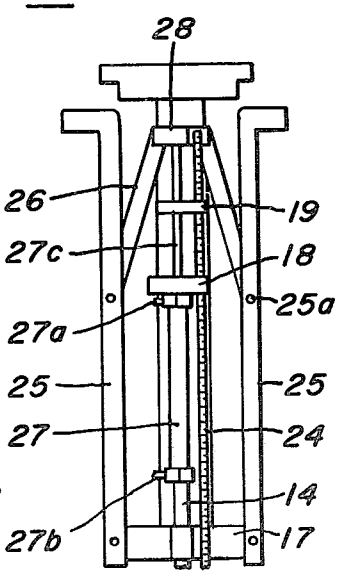

As particularly shown in FIGS. 3, 4, 4A and 4B, the pair of operating arms 25 extend upwardly and are pivotally connected, somewhat centrally therealong, at 25*b* to outer ends of a pair of associated connecting lever arms 26 to define a somewhat lazy tong type of construction. The pair of connecting lever arms 25 are pivotally connected at their inner, upper ends to a piston-operated cross head piece 28 by pivot pins 26*a*. Inner and outer, upwardly collapsing and spreading movement of the operating arms 25, such as shown in FIGS. 4A and 4B, is effected by upward and downward movement of piston rod 27*c* of a dual-acting fluid or pneumatic motor 27. The fluid motor 27 is shown mounted to extend from the upper end of the central column or support rod 14; its piston rod 27*c* carries the cross head piece 28. Fittings 27*a* and 27*b*, at opposite ends of the motor 27, enable it to be moved in a positive, dual-acting manner in both directions by reversing the air pressure flow into and from such fittings.

Maximum expansion of the operating arms 25 is controlled by cross-extending, stop or position limit block 19 which has a threaded bore therethrough to adjustably receive an adjustment screw shaft 24. The block 19 loosely bypasses the piston rod 27*c*, centrally therethrough. A cross piece or motor support block 18 is secured on the front end of the fluid motor 27 and to and between the pair of opposed members of the breast plate assembly 20. The block 18 has a central bore through which the piston rod 27*c* passes, and also an open-end slot through which the shaft 24 extends. As shown particularly in FIGS. 10 and 10*a*, see also FIGS. 1 and 2, the adjustment shaft 24 may be controlled by a hand crank 22. The crank 22 is shown secured on the outer end of an operating shaft 22*a* and a pinion 22*b* is secured on its inner end. The shaft 22*a* is journaled within a housing 23 which also receives the lower end of the adjustment shaft 24. It will be noted that the teeth of the pinion 22*b* are adapted to mesh with teeth 24*b* of a planetary gear wheel 24*a* that is secured on a lower end portion of shaft 24. Thus, by turning the hand wheel 22, the adjustment screw or rod 24 may be employed to move the stop or limit block 19 upwardly and downwardly thereon and with respect to the piston-operated head piece 28 of the fluid motor 27 (see FIGS. 4, 4A and 4B). If desired, a flexible adjustment may be used and directly connected to the operating crank 22.

Steam and heat supplying tubular assembly G is, as particularly shown in FIG. 3, secured in position within and along the vertical spacing defined by the perforated plate assembly 20 and thus, within a steam-dispersing chamber defined thereby. The assembly G consists of pairs or a group of series-connected inner tubular members that extend in a spaced relation along and within an associated group of concentric, outer, perforated tubular members. This type of assembly has been previously described in detail in my copending application Ser. No. 877,947, filed Feb. 15, 1978, entitled "Heat Conditioning Apparatus for Shirt or Blouse-Like Garments." The Inner, closed-wall group of connected tubular members supply heat to the spacing between their outer wall portions and inner wall portions of the associated, concentric group of outer, perforated, steam-burst-dispensing tubular members, as indicated by the flow circuit arrangement of FIG. 11. As shown in this figure, somewhat wet steam may be supplied to the inner, series connected group of pipe members for applying heat through their walls to dry steam being supplied individually to the outer, steam burst supplying tubes. Steam flowing from the outlet of the inner series group is then supplied to the heat exchanger 12 and thus, to the air which is being introduced into the air heating chamber A. On the other hand, steam which is dry or from which condensate has been separated out, is supplied to the spacing between the inner tubular members and the surrounding outer members for direct introduction, as shown in FIG. 1, both into lower mixing chamber B and into upper garment finishing chamber C.

Figure 5:
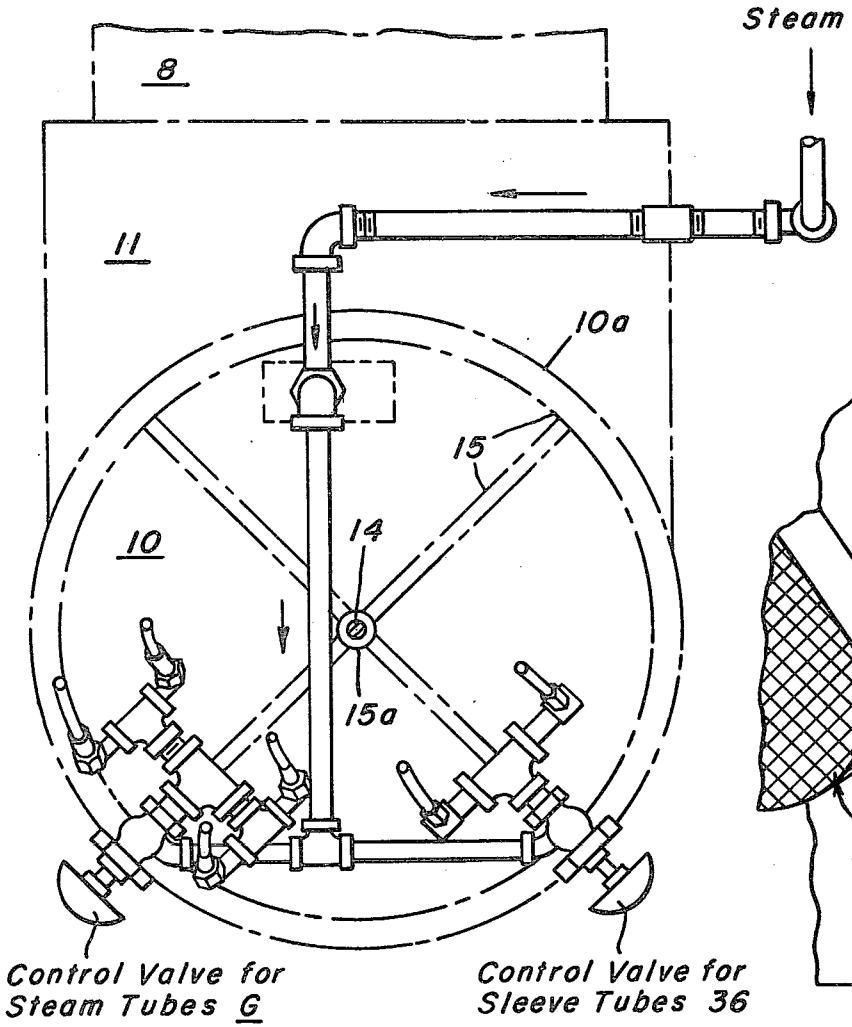
FIG. 5 is an enlarged horizontal section looking downwardly towards the inside of an air heating chamber of the apparatus; it particularly shows steam lines and control valves for a centrally positioned and upwardly extending steam supplying tubular assembly.

FIGS. 1 and 5 are illustrative of hand valves that may be utilized for controlling the flow of steam to each part of the tubular assembly G. Dry steam may be supplied in bursts, as electrically controlled by a steam solenoid shown in FIG. 11. As also illustrated in this figure and FIG. 1, dry steam is supplied to a pair of flexible sleeve supply tubes 36 that extend along an associated one of the arms 25 for applying dry steam to end nozzles 35. The nozzles 35 are adapted to supply steam directly within a pair of sleeve, shoulder and arm finishing chambers D that are defined by the spacing between the members of each pair of opposite, side-projecting shoulder and sleeve forming arm assemblies 30.

The breast plate assembly 20, as shown particularly in FIGS. 1, 2 and 4, extends above the central post or column 14, and is closed at its upper end by a neck-receiving and shaping cap 21. The cap 21 may be secured by small rivets 21*a* to upper end portions of the pair of back and front members of the plate assembly 20.

Each shoulder and arm, sleeve receiving assembly 30 has a pair of upper pin and slot, adjustably connected arm members 33 and 34. Inner member 34 is pivotally secured within an open side slot in the cap 21 by a pivot pin 34*a*. The outer arm member 33 is, at its outer end, pin and slot, adjustably connected to an outer, angle-shaped end connecting member 32 which, itself, is connected by a pin and slot connection to the outer end of a lower arm member 31. As shown in FIGS. 1, 3 and 4, an upper end portion of each operating arm 25 is pivotally secured to the inner end of an associated lower arm member 31 at 25*b*, in such a manner that inner and outer movement of the upper ends of the operating arms 25 will decrease and enlarge the effective spacing D and thus, the amount of stretch effected by the pair of arm assemblies 30 on sleeve portions of a garment carried in a suspended relation therefrom. It will be noted that the steam lines 36 are of flexible construction to permit expanding and contracting movement of the operating arm members 25.

For stretching and shaping the body or waist of a garment, a pair of opposite, vertically extending, end stretch rods or arms 40 are pivotally connected at 40*a* at their upper ends to the inner ends of the lower arm members 31 of each pair of arm assemblies. The stretch arms 40, as shown particularly in FIGS. 1 and 8, extend through an open central area defined by a vertically movable stretch carriage 50 and, at their lower ends, carry an adjustable slide block 41. Each slide block 41 is mounted for transverse sliding movement along an associated cross arm member 46. Each cross member 46 has a group of spaced-apart holes 46*a* therethrough to receive spring-pressed detent 42 that is carried by the slide 41. The detent 42 is adapted to be selectively positioned in one of the holes. In this manner, the end stretch arms 40 of the pair may be moved inwardly and outwardly inside the body of a garment to be conditioned by applying an outward end stretching force therebetween. The arms 40 provide a cross type of side seam or body stretch on the garment that is to be finished, as employed with associated V or angle-shaped ears 55*a* that extend from a pair of adjustable end clamps 55. The clamps 55 may be moved (see the solid and dotted line positions of FIG. 8) into and out of a cooperative clamping position with an associated arm 40 against the outer side of the garment body by pneumatic, dual acting fluid motors 57. Each motor has a piston rod 57*a* that is secured at its outer end to one of the end clamps 55. A pair of guide rods 56 extend through the clamps 50 to slidably position each clamp 55 for movement therealong.

The carriage frame 50 is adapted to provide a longitudinal stretch to the garment. It will be further noted that the non-permeable bag F will have folds such as to permit it to be moved with the carriage 50. As previously mentioned, it also may have drawstrings at its opposite open ends to secure them in place respectively on and about the mounting flanges 10*a* and 51.

The carriage frame 50 has a pair of cross-extending end pieces or members 52 (see FIG. 8) that are secured in spaced-apart relation by a pair of front and back, horizontally-longitudinally extending connecting members 53 that are shown bolted thereto. Each end piece 52 has an inner tab portion 52*a* within which the upper end of a piston rod 54*a* is secured (see also FIG. 1). As shown in FIG. 1, a fluid motor, such as a dual acting pneumatic motor 54, is mounted in an upwardly extending relation between the support base 9 and intermediate, fixed frame 45. Piston rods 54*a* extend from the motors 54 for raising and lowering the carriage 50. A side pair of ratchet-like or toothed guide rods 48 extend from the intermediate frame 45 upwardly along open-end slots 52*b* in the end pieces 52 (see FIG. 8). A carriage limit stop 49 is adapted to adjustably latch with the teeth of each ratchet rod 42 to provide a desired maximum upper limit of movement of the carriage 50 as effected by the motors 54.

The construction of the carriage 50 is particularly illustrated in FIGS. 8 and 9; it is provided with front and back positioned clamping and gripping means for the lower or selvedge edge of the garment to be finished. In this connection, a pair of fixed-position, inside clamps or back-up plates 60 are secured to the side rails 53 by a pair of upright, notched lugs or fingers 61. A cooperating pair of movably positioned, outside, plate-like side clamps 62 are adapted to cooperate therewith for clamping back and front sides of the garment body therebetween. Thus, a downward movement of the carriage 50 will cause the side clamping pairs 60, 62 to lengthwise stretch the body of the garment during a finishing operation thereon.

The inside or back-up plates 60 may be secured by a pair of upright fingers 61 and weld metal w on the inside of the front and back rail members 53 of the frame 50. On the other hand, the movable clamping or gripping plates 62 are, as particularly shown in FIGS. 8 and 9, mounted by nut and bolt means 69*a* on a pair of angle-shaped swing feet 64. A pair of upright, spaced-apart, mounting feet 63 provide a bifurcated assembly which may be secured by weld metal w to project outwardly from an associated side rail member 53 of the carriage 50. Each mounting foot 63 has a slotted portion 63*a* for providing a guided back and forth movement of a cross-extending, rod-like, motor-operated head shaft 70 therealong. As shown in FIG. 9, the head shaft 70 extends through the pair of swing feet 64 in such a manner that the forward end of a piston rod 68*b* of a positive, forward-acting fluid or pneumatic motor 68 is adapted to advance along the guide slot portions 63*a* to swing the feet 64 and the associated outer clamping plate 62 into a garment body clamping position with an associated inner, fixed plate 60. The lower end of the feet 64 are pivotally secured by a cross rod or shaft 64*a* between the pair of side feet 63.

The fluid motor 68 has a mounting tab 68*a* at its rear end that is carried by cross rod 66. A pair of tension springs 67 extend between cross rods 66 and 70 to normally urge the associated plate 62 to an outer or unclamping position. The fluid motor 68, upon the retention of a forward, positive, fluid pressure applied to fitting 68*c*, will retain the outer plate 62 in a clamping position against the outside of the garment. Backward movement of the piston rod 68, as effected by releasing fluid pressure from the motor 68, will cause each foot 64 to pivot or swing backwardly on the pin shaft 64*a*, as effected by the release of tension force build-up in the pair of springs 67. On the other hand, a forward movement of the piston rod 68*b* will move each foot 64 in a forward direction to thus move the clamping plate 62 carried thereby into a close, garment clamping engagement with an associated inside, back-up plate 60.

I claim:

1. In an apparatus for improved shaping and finishing a sweaterlike garment having a support stand housing and a column extending upwardly therefrom, having an air-supplying chamber within the housing, having a pair of shoulder and sleeve frames extending transversely outwardly from an upper end portion of the column, and with each of the pair of shoulder and sleeve frames having upper and lower arm members in an adjustably spaced-apart inwardly open and outward swingably connected relation with respect to each other from the column, the improvement comprising, a vertically movable carriage frame operatively positioned to extend transversely outwardly with respect to the column, means for vertically adjustably positioning said carriage frame along the column, a non-permeable flexible bag extending between the housing and said carriage frame to define an enclosed lower air and steam mixing chamber therebetween, an upwardly extending heat and steam supplying tubular assembly of inner and outer tubular members positioned to extend along the column, said inner tubular members defining a heat-supplying closed steam flow system and said outer tubular members having steam-delivery openings therealong, the garment to be finished being adapted to be mounted with its shoulder and sleeve portions over the upper and lower arm members of the pair of frames to define an upper chamber and with its open end body extending downwardly therefrom in an outwardly spaced relation with respect to said tubular assembly, means carried by said carriage frame for gripping a lower open end portion of the body of the garment to define an intermediate chamber therewithin, means for supplying hot dry steam to the tubular outer members and through their delivery openings into the lower chamber defined by said bag and into the intermediate chamber defined by the body of the garment, means for supplying lower quality steam to said closed steam flow system of said inner tubular members for heating the steam being supplied to said outer tubular members, means for supplying lower quality steam to the air-supplying chamber of the housing for preliminarily heating air therewithin, means for supplying heated air from the air-supplying chamber upwardly into the lower chamber to mix with steam being supplied thereto from said outer tubular members, means for moving the mixture of steam and hot air from the lower chamber upwardly through said carriage frame and the open bottom end portion of the garment being finished into the intermediate chamber to mix with steam being directly supplied thereto by said outer tubular members, and means for simultaneously directly supplying hot dry steam into the upper chamber from inner end portions of the pairs of shoulder and sleeve frames into and along shoulder and sleeve portions of the garment being finished.

2. In an apparatus as defined in claim 1, perforated breast plate means along the column enclosing said tubular assembly in an outwardly positioned relation with respect thereto, said breast plate means being adapted to supply hot dry steam therealong from said outer tubular members through the perforations into said lower mixing and intermediate chambers.

3. In an improved garment finishing apparatus as defined in claim 2, said means for supplying steam within the spacing defined by the upper and lower arm members of the shoulder and sleeve frames being independent of said tubular assembly, extending along and outwardly of said breast plate means, and having nozzles resting on lower inner portions of the lower arm members; and said nozzles being directed into the spacing between the upper and lower arm members of the pair of shoulder and sleeve frames.

4. In an improved garment finishing apparatus as defined in claim 2, a pair of operating arms pivotally mounted on said column to extend upwardly therefrom and outwardly of said breast plate means, said pair of operating arms being pivotally connected at their upper ends to inner end portions of the lower members of the pair of shoulder and sleeve frames, lever means pivotally connected to intermediate length portions of said pair of operating arms, pneumatic motor means operatively connected centrally to said lever means for moving said pair of operating arms between substantially vertical and outwardly diverging positions to open and close the spacing between the upper and lower arm members of the pairs of shoulder and sleeve frames, shaft means cooperating with inner end portions of said lever means for adjusting the maximum outward diverging movement of said pair of operating arms, and said shaft means extending along the column towards a lower end thereof and having manual adjusting means adjacent the stand housing.

* * * * *